US005439521A

United States Patent [19]

Rao

[11] Patent Number: 5,439,521

[45] Date of Patent: Aug. 8, 1995

[54] DISPENSER FOR STORING AND DISPENSING MOISTENED TOILET TISSUE

[76] Inventor: Muralidhara S. Rao, 2481 Corteland Dr., Pittsburgh, Pa. 15241

[21] Appl. No.: 239,472

[22] Filed: May 6, 1994

Related U.S. Application Data

[63] Continuation of Ser. No. 912,259, Jul. 13, 1992, abandoned.

[51] Int. Cl.[6] ..... B05C 3/02

[52] U.S. Cl. ..... 118/415; 118/419; 118/423; 242/598.6; 242/599.1

[58] Field of Search ..... 118/43, 400, 407, 415, 118/419, 423; 242/598.6, 599.1

[56] References Cited

U.S. PATENT DOCUMENTS

| | | | |
|---|---|---|---|
| 3,633,838 | 1/1972 | Krueger | 242/598.6 X |
| 3,707,945 | 1/1973 | Boone | 118/234 |
| 3,775,801 | 12/1973 | Walker | 118/43 X |
| 3,837,595 | 9/1974 | Boone | 242/55.3 |
| 3,995,582 | 12/1976 | Douglas | 118/43 |
| 4,089,481 | 5/1978 | Ciuci | 242/55.53 |
| 4,101,026 | 7/1978 | Bonk | 206/205 |
| 4,171,047 | 10/1979 | Doyle et al. | 206/210 |
| 4,181,218 | 1/1980 | Cox | 206/205 |
| 4,219,129 | 8/1980 | Sedgwick | 221/63 |
| 4,235,333 | 11/1980 | Boone | 206/233 |
| 4,244,493 | 1/1981 | Harrison | 206/409 |
| 4,535,912 | 8/1985 | Bonk | 221/46 |
| 4,566,606 | 1/1986 | Kling | 221/25 |
| 4,984,530 | 1/1991 | Dutton | 118/43 |

*Primary Examiner*—David A. Simmons
*Assistant Examiner*—J. Sells
*Attorney, Agent, or Firm*—Arnold B. Silverman; Jolene W. Appleman

[57] ABSTRACT

A dispensing container for moist toilet tissue includes an elongated housing having a circumferential wall and a pair of endwalls. A dispensing opening for discharging tissue from said housing is provided and means for resisting full rotation of said housing about its longitudinal axis is provided. A solution which may include cleansing and medicinal constituents as well as others, is provided within the housing. In one embodiment a tubular portion defines a passageway for receipt of a toilet tissue roll holder rod. In one embodiment the housing has a hinged opening for permitting access to the interior thereof. In another embodiment the container is sealed and disposable and in another embodiment two sections are mechanically separable and rejoinable so as to facilitate refilling the solution and the toilet tissue.

26 Claims, 6 Drawing Sheets

DISPENSER FOR STORING AND DISPENSING MOISTENED TOILET TISSUE

This is a continuation of application Ser. No. 07/912,259, filed Jul. 13, 1992, now abandoned.

BACKGROUND OF THE INVENTION

1. Field of the Invention

The present invention provides a dispensing container for use with a toilet paper roll holder to store and dispense moist toilet tissue and, more specifically, it relates to such a dispenser which will facilitate and enhance performance by toilet tissue without requiring alteration of conventional toilet tissue holders.

2. Description of the Prior Art

In conventional bathrooms it has been known to provide wall mounted fixtures adjacent to the commode for purposes of securing rotatably a roll of toilet paper. The toilet paper roll typically has a spirally wound cardboard center around which the toilet paper is wound in a roll with the cardboard tube core being rotatably received on the toilet paper roll supporting rod Typically, the fixture to which the toilet paper is secured contains a pair of spaced projecting wall portions having confronting relatively spaced inwardly open recesses in which opposed ends of the two piece spring biased toilet paper supporting rod may be secured. Such a system, which facilitates conventional withdrawal of paper for sanitation purposes, provides dry paper for use by those employing the commode.

It has been known to provide a decorative enclosure to surround the toilet paper roll. See U.S. Pat. No. 4,089,481.

It has also been know for numerous purposes, such as cleaning of the hands, to provide moist towlettes which facilitate such cleaning. These have been provided in Individual foil or plastic packages as well as in multi-unit dispensing containers. See, generally, U.S. Pat. Nos. 4,101,026; 4,171,047; 4,181,218; 4,219,129; 4,244,493; 4,535,912; and 4,566,606.

It has also been known to position such moist towel dispensers in the bathroom in close proximity to conventional dry toilet paper dispensers. See U.S. Pat. Nos. 3,837,595 and 4,235,333.

U.S. Pat. No. 3,995,582 discloses the use of a coreless rolled web of moisture absorbent material positioned within a dispenser along with a liquid. The concept centers around a liquid level L being relatively low and the coreless material moving freely under the influence of gravity downward into the liquid as the outer plies are removed. This dispenser is not adapted for use with conventional toilet paper roll holders.

In spite of the foregoing, there remains a very real and substantial need for a system of providing toilet tissue moistened with a desired solution in a manner which may be substituted for conventional dry toilet tissue or employed in addition thereto, but which in either event is adapted to function with a conventional toilet tissue holder.

SUMMARY OF THE INVENTION

The present invention has met the above described need by providing a dispensing container for moist toilet i tissue which has an elongated housing including a circumferential wall and a pair of endwalls. In one embodiment, means are provided for engagement with a container support. A tubular portion of the housing defines a passageway for receipt of the toilet paper roll holder rod between the two endwalls. A dispensing opening for delivery of moist toilet tissue is provided The housing has rotation resisting means which serve to resist undesired rotation of the housing when an individual proceeds to withdraw a portion of the toilet tissue.

A solution is preferably provided within the housing such that the paper or tissue as it is withdrawn will pass through the solution to pickup liquid therefrom The rotation resisting means may take the form of a generally outwardly projecting rib.

The housing may be a unitary sealed housing which is adapted to be disposable, or in the alternate may be a refillable container. As to this latter category, a preferred embodiment involves providing a hinged access door and a further preferred embodiment involves providing a multi-piece container which may be opened to replace paper and solution and resealed once the paper and solution have been introduced.

It is an object of the present invention to provide a dispensing container for moist toilet tissue which is adapted for use with conventional toilet paper holders It is a further object of the invention to permit toilet paper to be used in an easy fashion, but with enhanced hygienic benefits.

It is another object of the present invention to provide an aesthetically pleasing toilet paper dispenser of the type described.

It is a further object of the invention to provide such a dispenser which may in one form be provided as a sealed disposable dispensing container and in others as a refillable housing.

These and other objects of the invention will be more fully understood from the following description of the invention in reference to the illustrations appended hereto.

DESCRIPTION OF THE PREFERRED EMBODIMENT

As used herein, the term "toilet tissue" shall refer to absorbent sheet-like materials which are suitable for use as a substitute for dry conventional toilet tissue which will have adequate tensile strength as to not fracture undesirably when pulled from a dispenser in moist condition. This expression shall expressly embrace but not be limited to fibrous materials of the type conventionally used in moist towlettes.

The expression "solution" as employed herein shall referred to water, alcohol, other solvents adapted for safe use in contact with human skin and may also include desired additives such as cleansing agents, medication, emollients and combinations thereof.

Figure 1:
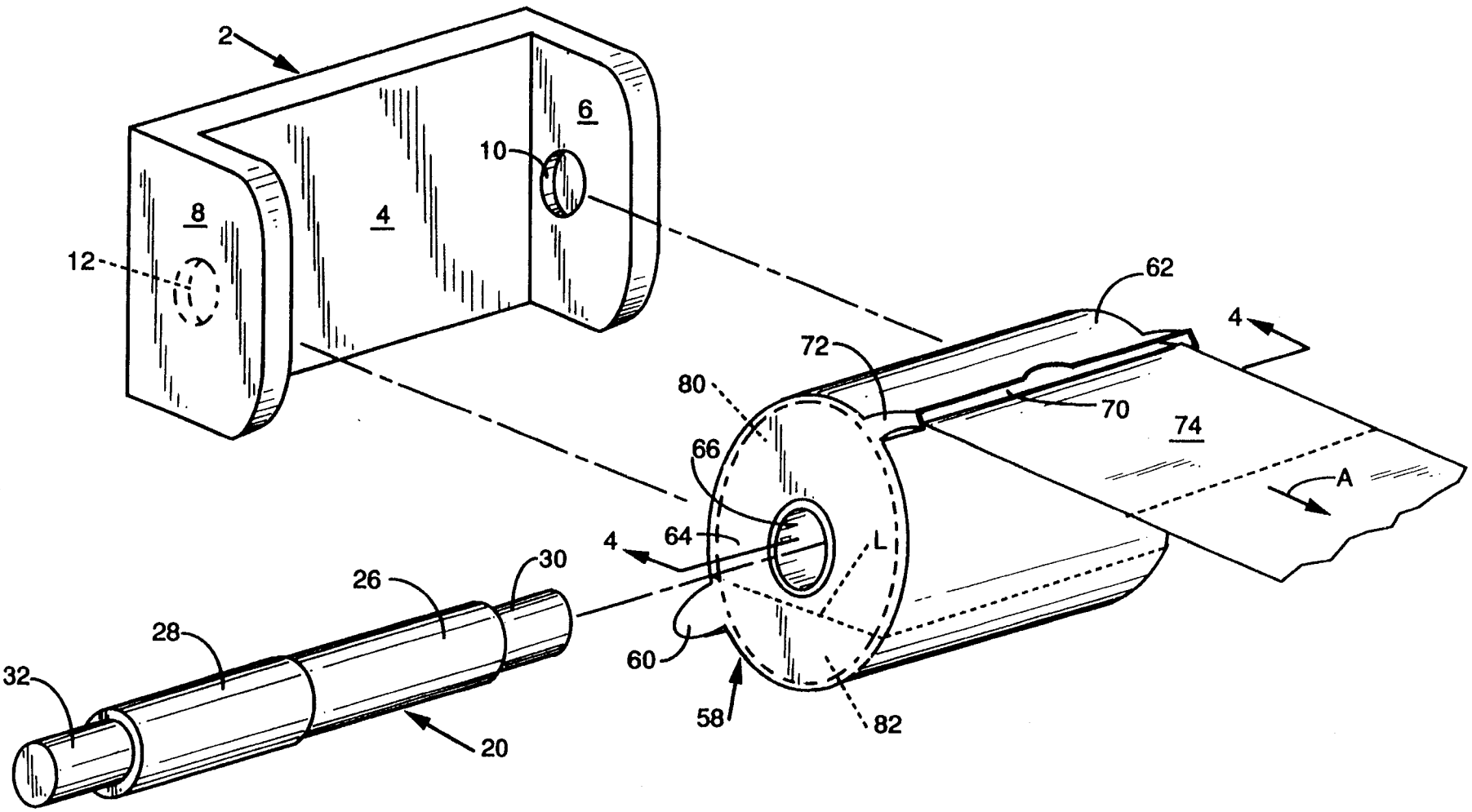
FIG. 1 illustrates an exploded view of a form of dispensing container of the present invention and an associated toilet paper holder.

Referring now in greater detail to FIG. 1, there is shown a wall mounted toilet roll supporting rack 2 which has a rear wall 4 and a pair of sidewalls 6, 8, each of which has an inwardly open recess 10, 12 facing the other for receipt of the toilet paper roll holder rod 20. Rod 20 consists of first tubular member 26, a second tubular member 28 into which the first tubular member 26 is partially received in telescoping fashion and a coil spring (not shown) received within the interior of the two telescoping rod elements 26, 28 so as to the urge the same apart. Tubular section 26 has outwardly projecting boss 30 and tubular section 28 has outwardly projecting boss 32. In securing the rod 22 to the supporting bracket the spring is compressed so as to permit the bosses 30, 32 to be inserted, respectively, into recesses, 10, 12 and be resiliently maintained therein.

The housing 58 is generally cylindrical in shape and has a rearwardly projecting hollow rib 60 which is generally coextensive in length with the body portion 62 of the dispenser. Sealingly connected at one end of the body portion is an endwall 64 having an aperture through which passageway 66 extends. Not shown in this view is a second endwall secured to the body 62 at the opposite end and having a similar opening for the passageway 66. The passageway 66 facilitates insertion of the toilet paper holder rod 20 through the dispenser to facilitate rotatable securement to support rack 2.

Referring still to FIG. 1, there is shown a discharge opening 70 which in the form shown has a chute 72 out of which the toilet tissue 74 will pass in the direction shown by the arrow A. In a preferred embodiment of the invention, a roll of toilet tissue 80 (shown in phantom in FIG. 1) is rotatably mounted about the passageway 66 and is immersed in liquid 82 of a level L contained within the sealed housing.

Seal means (not shown in this view) are positioned within the housing chute 72 so as to resist undesired leakage of liquid 82 out of the housing. The seal means also to serve as a wiper to resist removal of excess liquid with the tissue 74, and to resist evaporation of the liquid 82 from the interior of the dispenser housing to the exterior.

Figure 2:
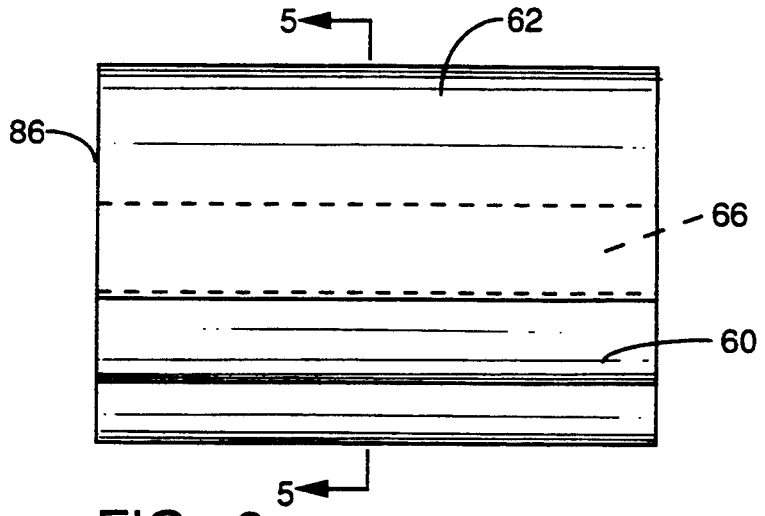
FIG. 2 is a rear elevational view of the embodiment of FIG. 1.

Referring to FIG. 2, there is shown a rear view of the body portion 62 of the dispenser and the other endwall 86 which has the passageway 66 going therethrough. Projecting rearwardly and generally downwardly from the rear surface of body 62 is rib 60 which is preferably hollow and serves to engage rear wall 4 of support rack 2 and resist undesired full rotation of the housing about the longitudinal axis thereof which passes therethrough passageway 66.

Figure 3:
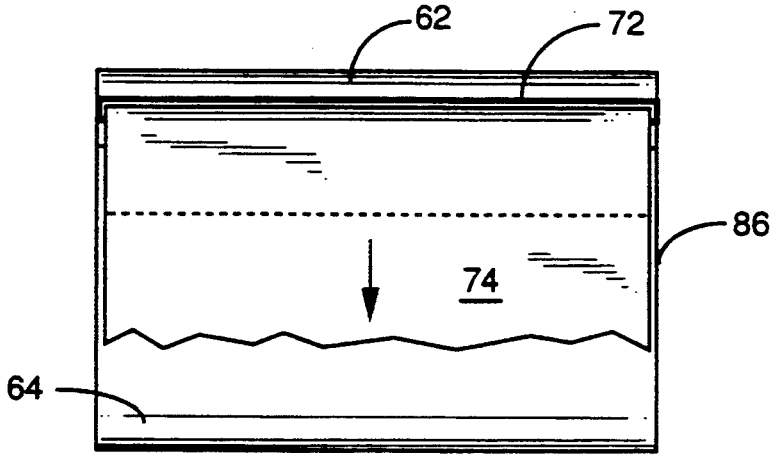
FIG. 3 shows a front elevational view of the dispenser of FIG. 1.

FIG. 3 is a front elevation of the dispenser showing the dispenser with body 62, and discharge chute 72 with toilet tissue 74 being withdrawn therefrom.

Figure 4:
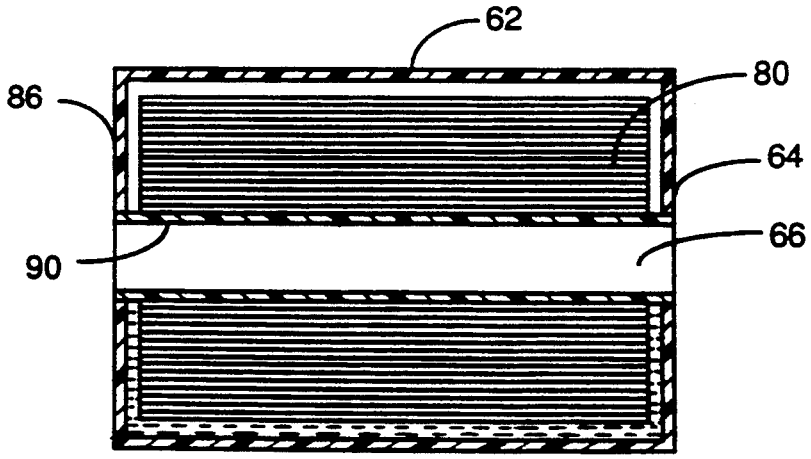
FIG. 4 is a longitudinal cross-section through the dispenser shown in FIG. 1 taken through 4—4.

FIG. 4 is a longitudinal cross-sectional illustration of the housing 58, showing the toilet tissue roll 80, generally cylindrical body 62, the endwalls 64, 86 and the passageway 66 for receipt of rod 2. An annular divider wall 90 which is generally cylindrical in shape defines the passageway 66 and extends from endwall 64 to endwall 86 and is secured thereto.

In general it will be preferred that the discharge chute 72 be positioned above the level of the longitudinal axis of the passageway 66. This chute position refers to the position when the rotation resisting means 60 is in engagement with the front wall 4 of the toilet paper supporting rack 2. It will also be preferred to have the solution upper surface (FIG. 1) be up to the lowest portion of annular portion 90 to fully wet the toilet tissue, but no higher than the chute opening.

Figure 5:
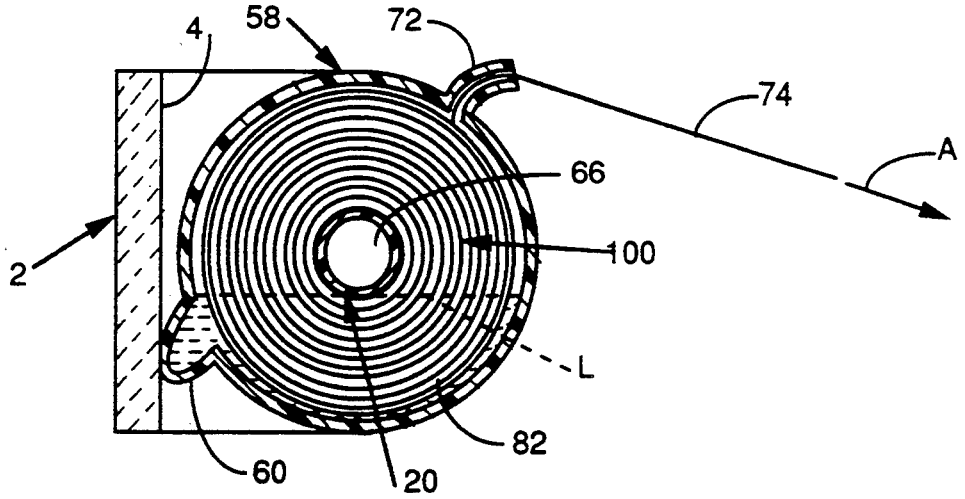
FIG. 5 is a cross-sectional illustration of the dispenser and the toilet paper holder of FIG. 1 taken through 5—5.

Referring to FIG. 5, there is shown a cross-section of the dispensing container in securement with the toilet roll supporting rack 2. The toilet roll rack 2 and the rod 20 serve to secure the dispenser housing 58 in the desired position. In the form shown, the passageway 66 has the rod 20 passing therethrough, the coil of toilet paper 100 has its exposed end 74 being pulled out of the dispenser in the direction indicated by the arrow A. Of particular interest is the fact that the rib 60 is in engagement with the front surface wall 4 of the toilet paper rack 2 such that pulling of the toilet paper 74 will not result in any farther clockwise movement of the dispenser and will place the paper in tension and permit fracture of the paper 74 at the desired length.

Figure 6:
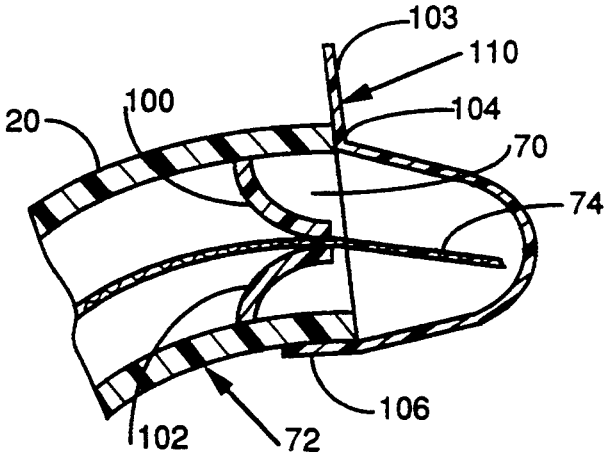
FIG. 6 is a detailed cross-sectional illustration of the dispensing chute of the container of the present invention prior to removal of the closure.

FIG. 6 illustrates a preferred construction of the chute 72 with the paper 74 positioned therein as the dispenser might be provided from the supplier. A pair of cantilevered resilient gasket means 100, 102 are in intimate engagement with opposite sides of the paper 74. The resiliency of the gasket materials 100, 102 is such that they will engage on both sides of the toilet paper 74 sufficiently intimately as to serve as doctor blades resisting undesired passage of excess moisture out of the container and will also provide a seal to resist leakage and undesired evaporation of the solution 82. In the form shown, a strippable closure member 110 which may be made of a polymer resin film which is either self-bonded or adhesively bonded to spout 72's secured overspout opening 70. Closure member 110 has a tab 103 with a first portion 104 secured to a first portion of chute 72 and a second portion 106 secured to another portion of the chute 72. When it is desired to initiate use of the product the tab 102 may be manually engaged and the closure 110 which is preferably coextensive with the chute opening 70 may be removed thereby permitting access to the paper 74 to facilitate withdrawal thereof. In lieu of closure 110, the dispenser may be provided in a sealed plastic bag or box, or with a snap fit closure or other suitable closure means.

It will be appreciated that in the embodiment of FIGS. 1 through 6 the housing may be formed as a sealed hollow article composed of a synthetic resinous material. The parts may be molded and then joined so as to create a unitary construction. This embodiment provides a disposable unit.

Figure 7:
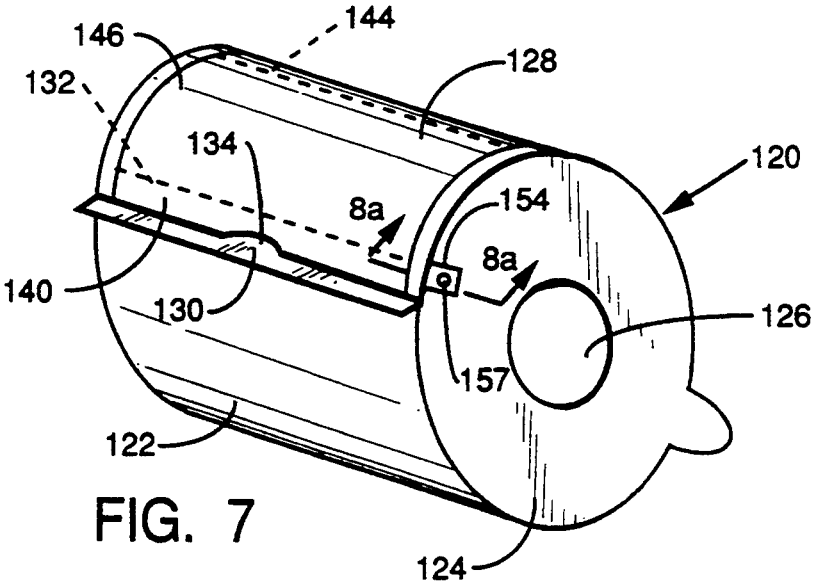
FIG. 7 is a perspective view of a modified form of the dispenser of the present invention.
Figure 8:
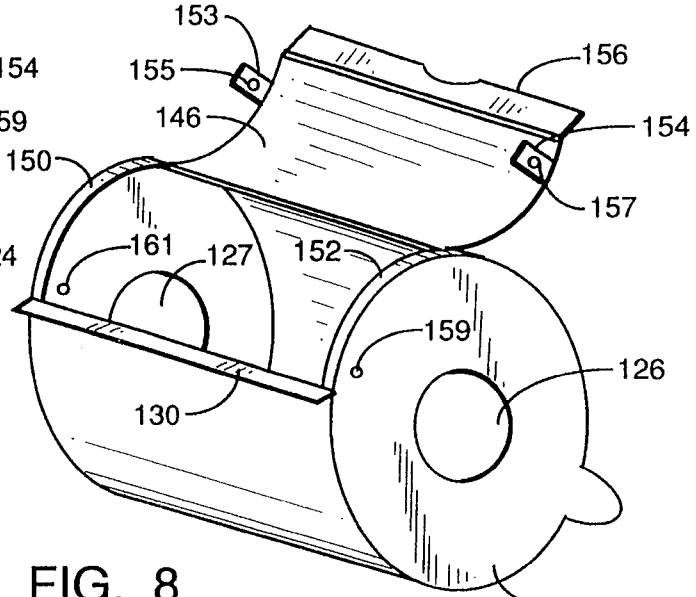
FIG. 8 is a perspective view of the dispenser of FIG. 7 shown in open position
Figure 8A:
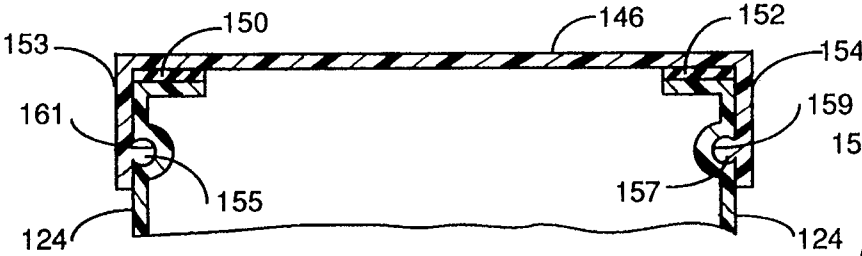
FIG. 8*a* shows a cross-section of locking tabs employed to secure the movable panel in closed position as taken through 8*a*—8*a* of FIG. 8.

Referring to FIGS. 7 and 8, another embodiment of the invention wherein refilling of the toilet tissue and/or solution may be accomplished In this embodiment the dispensing container 120 has a circumferential wall 122 and endwall 124 through which an opposed endwall (not shown) which may be identical to endwall 124. Roll supporting rods such as rod 20 of FIG. 1 passes through openings 126, 127 with the openings 126, 127 being so sized as to be in intimate contact with the exterior surface of the rod 20 (with or without interposed sealing materials to resist solution evaporation. In this embodiment, however, a pivotable access door or panel 128 is provided. More specifically, adjacent the discharge shelf 130 is a first integrally formed hinge 132 which permits one to engage the door as at recess 134 and pivot the panel portion 140 generally upwardly about hinge 132 to facilitate threading the paper through the discharge opening and shelf 132. Also, this embodiment provides a second integrally formed hinge 144 about which the entire door or top panel 146 may be pivoted to provide access to the interior to either thread the toilet paper through the opening and shelf 132 or to add solution. The embodiment is shown in the open position in FIG. 8. The hinge means 132,144 may be provided as thinned zones which are integrally molded into the panel 132.

If desired, the panel 140 may be formed separately from panel 146 to provide two relatively spaced separate openable panels each adapted to have a closed position and open position.

It will be appreciated that suitable sealing material 150,152,156 such as an elongated compressible gasket may be applied along the edges 150, 152, 156 so as to facilitate sealing the container when panels 140, 146 are in closed position.

Referring to FIGS. 5, 7, 8 and 8a, a means for securing panel portions 140, 146 in closed position with seals 150, 152, 154 compressed will be considered. Tabs 153, 154 (which may be integrally formed) each have inwardly projecting bosses 155, 157 which are removably snap fit into recess 159 and 161.

Figure 9:
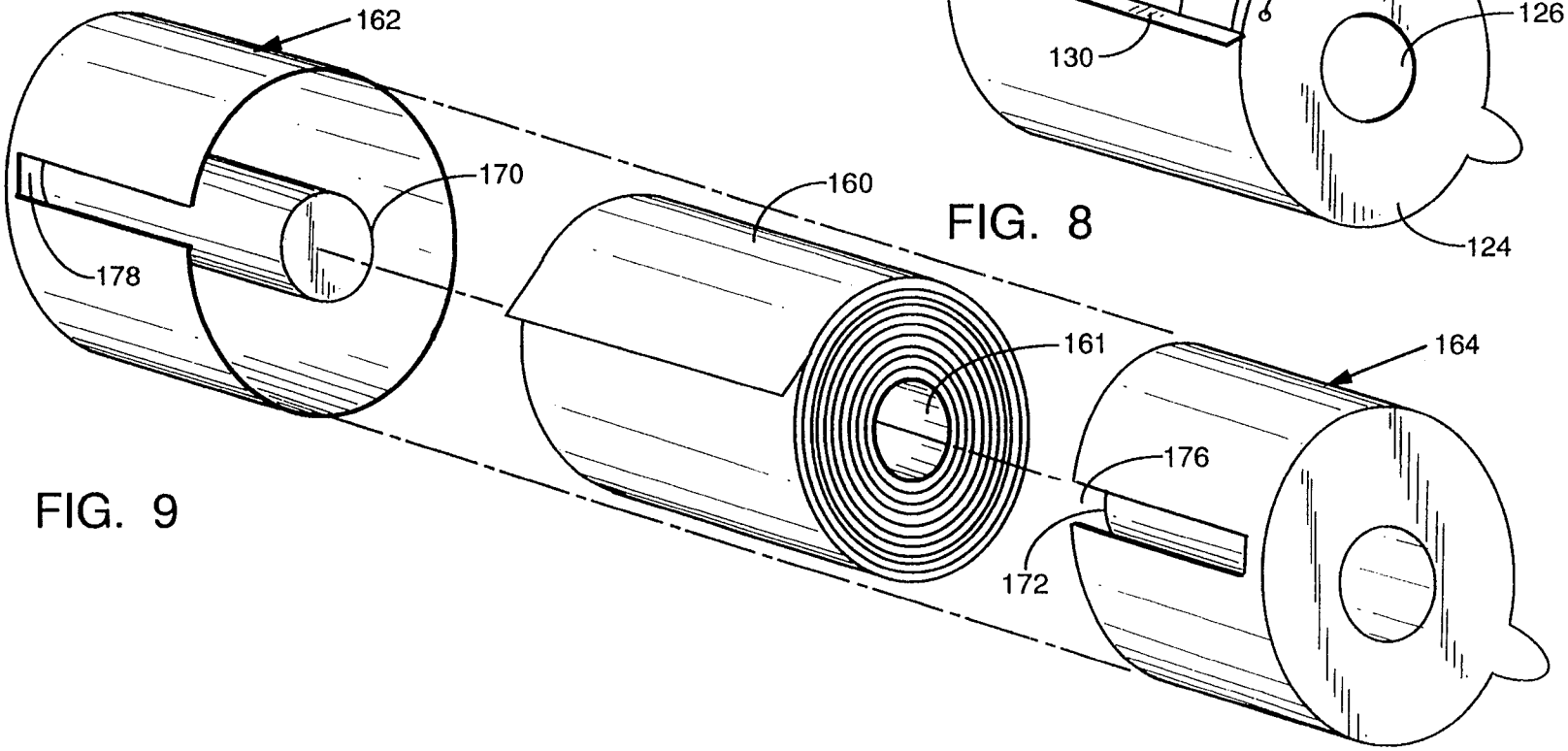
FIG. 9 is an exploded view of another embodiment of the invention wherein a multi-piece housing is employed.
Figure 11:
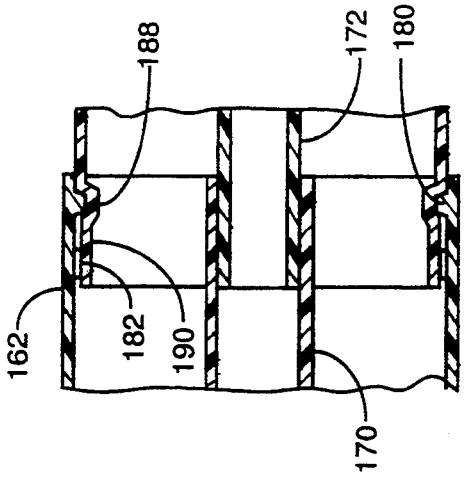
FIG. 10 and 11 respectively are partial cross-sectional views showing the joining means and seal means of another embodiment of this invention.
Figure 10:
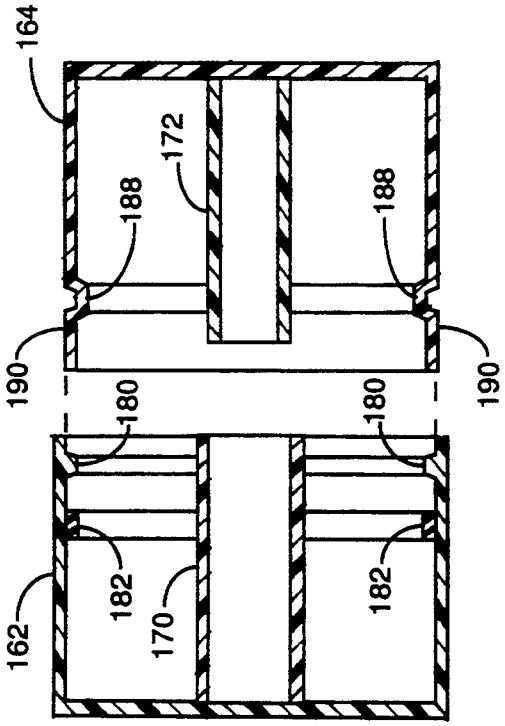

Referring now to FIGS. 9 and 10, yet another embodiment of the invention will be considered. In this embodiment, a roll 160 of toilet tissue has an open core 161 and is adapted to be received within the housing which, in the form shown, is composed of section 162 and section 164. The two sections 162,164 contain respectively tubular portions 170, 172 which are adapted to telescope with 172 being received in portion 170 so as to provide the central rod which passes through the core 161 of toilet tissue roll 160. Also, the sections 162, 164 cooperate to define a discharge opening 178. In effecting closure of the embodiment shown in FIG. 9, the two sections are merely moved axially in a relative closing position so that mechanical interengagement may be effected and tubular portion 172 enters tubular portion 170. Referring to FIG. 10, an annular radially inwardly projecting rib 180 is disposed adjacent to an annular gasket 182 on section 162. A cooperating annular groove 188 and adjacent annular flat surface 190 are provided on section 170. As shown in FIG. 11, upon closing these elements it will be seen that the annular rib 180 is snap fit into annular groove 188 and the gasket 182 is sealingly engaged with surface 190. Passageway defining sections 172 and 170 are received in relative telescoping position and have their outer surfaces rotatably engaging core 161.

While in the preferred illustrated approach, shown in FIGS. 10 and 11, a snap fit engagement is shown, it will be appreciated that if desired a threaded interconnection may be employed.

Figure 12:
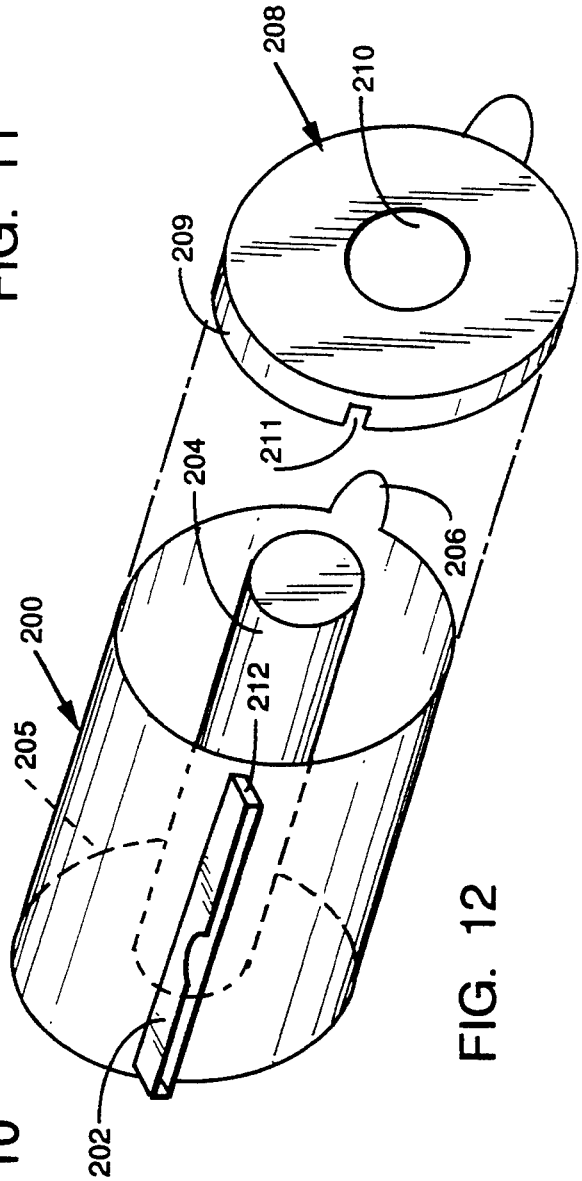
FIG. 12 is an illustration of another embodiment of the present invention.

Referring to FIG. 12, a further embodiment of the invention will be considered. In this embodiment, a generally cylindrical body 200 has a discharge chute 202, a central rod receiver 204 secured to endwall 205, and a rotation resisting projection 206. A closure 208, which is adapted to be sealingly applied over the section 200 in mechanical friction fit engagement with or without an interposed gasket is provided so as to seal the assembly. When closure 208 is in closed position, sidewall 209 has its interior surface overlying a portion of the outer surface of body 200 with slot 211 receiving end 212 of spout 202 and opening 210 receives rod receiver 204 which may have a free end adjacent to or projecting beyond opening 210.

It will be appreciated that in lieu of or in addition to the friction fit of FIG. 12 a snap fit such as that of FIGS. 9 through 11 may be employed in securing an end cap 208 of FIG. 12 to body 200. As a further alternative the cap 208 may be threadedly joined to body 200. In this last approach, it is preferable to have anti-rotation rib 206 terminate at an axial position short of the threaded portion of body 200 and cap 208.

Figure 13:
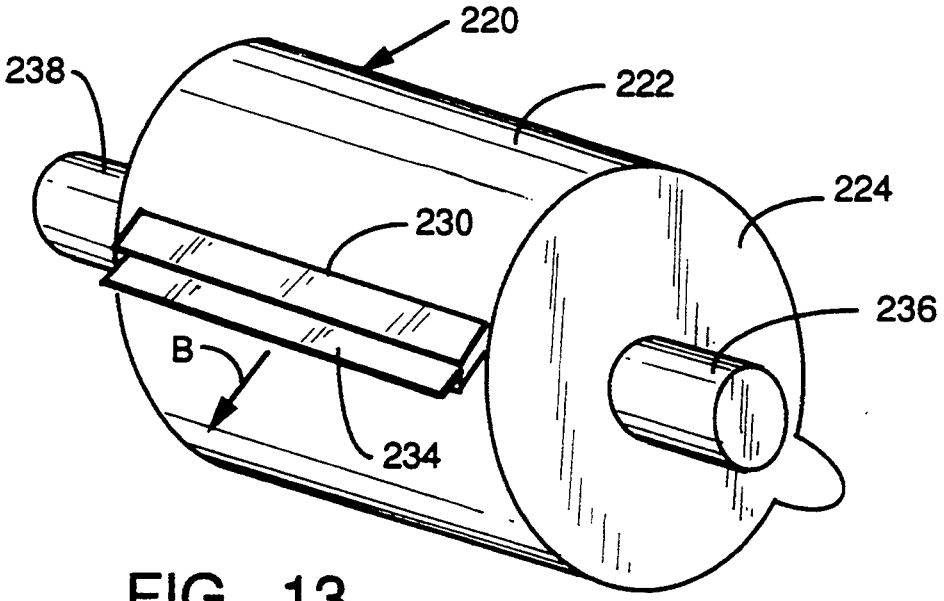
FIG. 13 is a perspective view of another embodiment of the invention.
Figure 14:
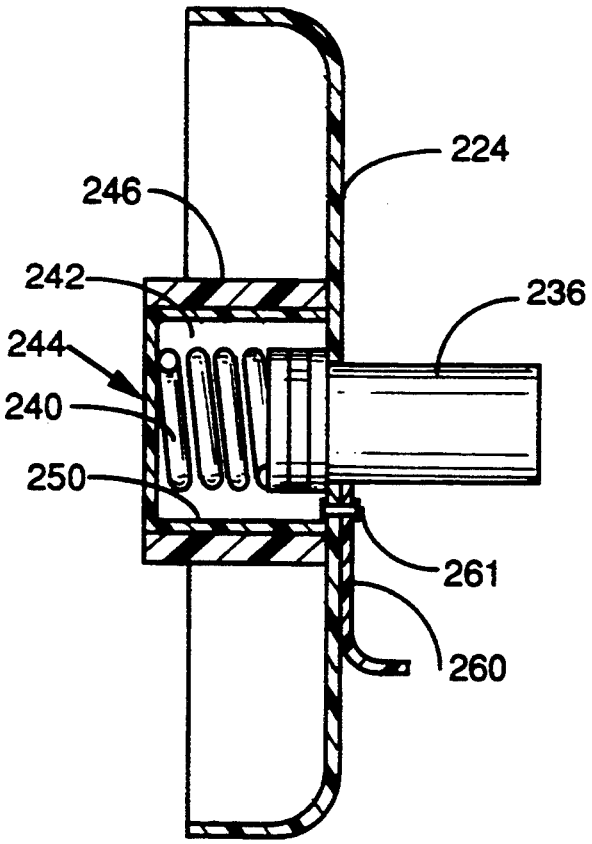
FIG. 14 is a cross-sectional illustration of a securement button of the embodiment of FIG. 13.

Referring to FIG. 13 and 14 there is shown a further embodiment of a disposable dispenser. A dispenser 220 has a generally cylindrical body 222, a first endwall 224 and an opposed endwall (not shown). A chute 230 facilitates withdrawal of moistened toilet tissue 234 therefrom in the directions indicated by arrow B. In this embodiment in lieu of a rod receiving passageway (such as 66 of FIG. 1) a pair of outwardly spring biased buttons 236, 238 are provided to engage rack recesses such as 10 and 12 in FIG. 1.

As shown in FIG. 14 the button 236 is urged outwardly by coil spring 240 which is disposed within recess 242 defined by receptacle 244 which is secured to or formed within endwall 224. If desired, the inner surface of the annular hub 246 of the core of a toilet tissue roll may be rotatably supported on the annular exterior surface 250 of receptacle 244. If desired, a movable cover 260 may be secured to endwall 224 so as to rotate about rivet 261 or slide (not shown) into button covering position when the spring 240 is compressed and the button 236 is in recess 242 prior to positioning the dispenser in engagement with a rack 2. Button 238 may be similarly configurated and retained.

The use of buttons 236, 238 in lieu of a rod receiving recess may be employed by the other embodiments of this invention including disposable embodiments if desired.

It will be appreciated that in the embodiment of FIGS. 9 through 11 and the embodiment of FIG. 12, the housings may be opened in such a manner as to permit replacement of the roll of toilet tissue and restoration of solution to the desired level with subsequent sealed reclosure for reuse. In the alternative, in lieu of the snap fit arrangement, thermal or adhesive joinder of the two sections 160, 162, can be effected to provide a disposable dispenser.

It will be appreciated that while, for purposes of illustration, preferred anti-rotation means in the form of an outwardly projecting rib 60, 206 has been provided, other means may be employed. For example, the rear surface of the housing body 62 might be made generally flat so as to engage the front surface 4 of the toilet paper support rack 2 when the paper is withdrawn and relative rotation of the housing is resisted. Also, segmented ribs, embossments, or other means that provide mechanical interference with undesired rotation, may be employed. It is not critical that there be no clockwise rotation of the housing, but rather it is preferred that full rotation does not occur so that at a certain point the housing will stop rotating and tension may be created in the paper to facilitate tearing the same. Also, at the chute, if desired, a serrated or other type of cutting edge which will facilitate severance of the desired length of toilet paper may be provided.

It will be appreciated that the present invention provides a dispensing container for providing wet toilet tissue in an efficient, economical manner by employing a dispensing container which is adapted to be received within a conventional toilet paper holder. In addition, the solution may be so provided so as to include, water, alcohol, cleansing agents, medication, emollients, and combinations thereof, or other desired materials. In this manner, enhanced cleaning action, comfort and sanitation may be achieved.

As toilet tissue is withdrawn from the chute 72 successive portions of the toilet tissue are moved through the solution reservoir, absorb the solution and move out of the dispenser. It is not critical whether the tissue is dispensed from the bottom of the roll or the top as in either case the tissue will pass through the solution first or, in a less preferred approach, absorbs the solution by wicking action.

Also, while not preferred, if desired, the toilet paper may be premoistened and placed in the housing without requiring the use of a separate liquid reservoir or supply within the housing.

Whereas particular embodiments of the invention have been described herein for purposes of illustration, it will be evident to those skilled in the art that numerous variations of the details may be made without departing from the invention as defined in the appended claims.

I claim:

1. A dispensing container for moist toilet tissue adapted to be supported by a conventional toilet tissue holder comprising:

an elongated housing having a longitudinal axis, a circumferential wall and a pair of endwalls, a dispensing opening for permitting removal of said toilet tissue from said housing, said housing being structured to be rotatably mountable on a conventional toilet tissue holder and having rotation resisting means for resisting full axial rotation of said housing by engaging a portion of said toilet tissue holder supporting said dispensing container, a supply of toilet tissue disposed within said housing having a tubular support rod opening extending from one said endwall to another said endwall for rotatable securement to said conventional toilet tissue holder by means of a rod passing through said support rod opening, and said rotation resisting means being so positioned with respect to said dispensing opening that rotation of said housing will be stopped with said dispensing opening readily accessible for removal of said toilet tissue.

2. A dispensing container for moist toilet tissue adapted to be supported by a conventional toilet tissue holder comprising:

elongated housing having a circumferential wall and a pair of endwalls, each endwall having spring biased support means for engaging a dispenser supporting rack a dispensing opening for permitting removal of said toilet tissue from said housing, said housing being rotatably mountable on a conventional toilet tissue holder and having rotation resisting means for resisting full rotation of said housing with respect to said passageway by engaging a portion of said toilet tissue holder supporting said dispensing container, a supply of toilet tissue disposed within said housing, and said rotation resisting means being so positioned with respect to said dispensing opening that rotation of said housing will be stopped with said dispensing opening readily accessible for removal of said toilet tissue.

3. The dispensing container of claim 1 including said dispensing container having said supply of toilet tissue in the form of a roll of tissue rotatably supported by said tubular portion.

4. The dispensing container of claim 3 including a reservoir of liquid disposed within said housing in contact with at least a portion of said toilet tissue.

5. The dispensing container of claim 4 including seal means on said dispensing opening for resisting leakage of said liquid.

6. The dispensing container of claim 5 including said seal means providing a sufficiently intimate seal to resist evaporation of said liquid through said seal means.

7. The dispensing container of claim 3 including said liquid containing at least one material selected from the group consisting of cleansing agents, medication, emollients and combinations thereof.

8. The dispensing container of claim 7 including said discharge opening disposed at a higher level than the longitudinal axis of said tubular portion.

9. The dispensing container of claim 8 including said housing is a unitary sealed housing.

10. The dispensing housing of claim 4 including said liquid reservoir having a solution disposed therein at a level no higher than the lowest portion of said dispensing opening.

11. The dispensing container of claim 1 including said rotation resisting means including a generally outwardly projecting portion of said housing.

12. The dispensing apparatus of claim 11 including said projecting rotation resisting means including a hollow rib which is generally coextensive with the axial extent of said housing.

13. The dispensing container of claim 10 including said housing composed of a resinous plastic material.

14. The dispensing container of claim 10 including said housing dispensing opening having a generally outwardly projecting chute portion.

15. The dispensing opening of claim 14 including seal means disposed within said projecting dispensing passageway.

16. The dispensing container of claim 1 including said housing having at least one upper access panel which may assume a closed position and an open position to facilitate access to the housing interior.

17. The dispensing container of claim 16 including seal means for sealing said access opening when in said first position.

18. The dispensing container of claim 1 including said housing having two sections which when interconnected create a sealed chamber for receipt of said toilet tissue and said solution.

19. The dispensing container of claim 18 including said two housing sections being separable to facilitate introduction of said toilet tissue and solution and being rejoinable to provide a sealed housing.

20. The dispensing container of claim 19 including said two sections of said housing being secured to each other by mechanical interengagement.

21. The dispensing container of claim 18 including said sections having telescoping tubular cores for rotatably supporting a roll of toilet paper on the exterior thereof.

22. The dispensing container of claim 18 including said two sections being threadedly secured to each other.

23. The dispensing container of claim 18 including said two sections being in snap fit interengagement.

24. The dispensing container of claim 1 including receptacle means at least partially receiving said spring biased support means.

25. The dispensing container of claim 17 including locking means for securing said access panel in said closed position.

26. The dispensing container of claim 25 including said locking means having integrally formed tab means adapted for snap fit securement.

* * * * *